US012692663B2

(12) United States Patent
Steinmetz et al.

(10) Patent No.: US 12,692,663 B2
(45) Date of Patent: Jul. 28, 2026

(54) METHOD FOR PRODUCING WET-RUNNING FRICTION PAPER

(71) Applicant: Schaeffler Technologies AG & Co. KG, Herzogenaurach (DE)

(72) Inventors: Stefan Steinmetz, Essingen (DE); Gregor Mattern, Schoneberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 567 days.

(21) Appl. No.: 18/005,185

(22) PCT Filed: Jun. 9, 2021

(86) PCT No.: PCT/DE2021/100496
§ 371 (c)(1),
(2) Date: Jan. 11, 2023

(87) PCT Pub. No.: WO2022/012708
PCT Pub. Date: Jan. 20, 2022

(65) Prior Publication Data

US 2024/0035235 A1 Feb. 1, 2024

(30) Foreign Application Priority Data

Jul. 13, 2020 (DE) ..... 10 2020 118 410.7
Sep. 3, 2020 (DE) ..... 10 2020 123 040.0

(51) Int. Cl.

| | |
|---|---|
| ***D21H 27/28*** | (2006.01) |
| ***D21H 17/48*** | (2006.01) |
| ***D21H 21/18*** | (2006.01) |
| ***D21H 23/08*** | (2006.01) |
| *D21H 17/67* | (2006.01) |

(52) U.S. Cl.
CPC ..... *D21H 27/28* (2013.01); *D21H 17/48* (2013.01); *D21H 21/18* (2013.01); *D21H 23/08* (2013.01); *D21H 17/67* (2013.01)

(58) Field of Classification Search
CPC ..... D21H 27/28; D21H 17/48; D21H 21/18; D21H 23/08; D21H 17/67
See application file for complete search history.

(56) References Cited

U.S. PATENT DOCUMENTS

| | | | | | |
|---|---|---|---|---|---|
| 2,899,353 | A * | 8/1959 | Engel | D21H 17/35 | 524/510 |
| 5,300,562 | A * | 4/1994 | Coventry | C03C 25/34 | 524/596 |
| 5,714,544 | A * | 2/1998 | Ohya | C08G 59/3218 | 525/154 |
| 2007/0196401 | A1* | 8/2007 | Naruse | D21H 15/02 | 424/443 |
| 2011/0262720 | A1* | 10/2011 | Riebel | B32B 29/06 | 428/534 |
| 2013/0032445 | A1 | 2/2013 | Suzuki et al. | | |
| 2014/0296374 | A1 | 10/2014 | Mikuka | | |
| 2022/0243779 | A1 | 8/2022 | Steinmetz et al. | | |

FOREIGN PATENT DOCUMENTS

| | | | | |
|---|---|---|---|---|
| CN | 110701226 | A * | 1/2020 | F16D 69/023 |
| DE | 102019126429 | A1 | 1/2021 | |
| EP | 0004999 | A1 * | 10/1979 | B27N 3/00 |
| EP | 129022 | A3 | 1/1986 | |
| EP | 1874850 | B1 | 4/2006 | |
| GB | 2126594 | A | 8/1982 | |
| GB | 2163784 | A | 3/1986 | |
| GB | 2205592 | A | 12/1988 | |
| JP | H1036522 | A | 2/1998 | |
| WO | WO2007076335 | A2 | 12/2006 | |
| WO | WO2007076335 | A3 | 12/2006 | |
| WO | WO2013048627 | A1 | 8/2012 | |

OTHER PUBLICATIONS

Https://pubchem.ncbi.nlm.nih.gov/compound/Phenolate (Year: 2017).*
Https://www.sbhpp.com/products-applications/catalog/category/res-pfr/ (Year: 2020).*
Https://ars.els-cdn.com/content/image/1-s2.0-S0141813022022036-gr1_lrg.jpg (Year: 2022).*
See Corresponding Search Report for International Application PCT/DE2021/100496.

* cited by examiner

*Primary Examiner* — Abbas Rashid
*Assistant Examiner* — Stephen M Russell
(74) *Attorney, Agent, or Firm* — Davidson Kappel LLC

(57) ABSTRACT

A method is for producing a wet-running friction paper, at least containing a fiber fraction consisting of at least one type of fiber, a fraction of at least one filler, and a fraction of a binder based on phenol resin. The fiber fraction, the filler fraction and the binder dissolved as a phenolate solution are processed together in a paper production process to form a pulp, and the binder is subsequently precipitated by means of a precipitating agent, preferably diluted sulfuric acid, and the pulp applied to a long screen is dried and cured while the temperature is raised.

18 Claims, No Drawings

METHOD FOR PRODUCING WET-RUNNING FRICTION PAPER

CROSS-REFERENCE TO RELATED APPLICATIONS

This application is the U.S. National Phase of PCT Appln. No. PCT/DE2021/100496 filed Jun. 9, 2021, which claims priority to DE 10 2020 118 410.7, filed Jul. 13, 2020 and DE 10 2020 123 040.0, filed Sep. 3, 2020, the entire disclosures of which are incorporated by reference herein.

TECHNICAL FIELD

The present disclosure relates to a method for producing a wet-running friction paper which contains at least one fiber fraction consisting of at least one type of fiber, a fraction of at least one filler, and a fraction of a binder based on a phenol resin.

BACKGROUND

From the document GB-A-2 205 592, a wet-running friction paper described as a friction lining material made of a porous fiber base material, an inert filler and phenol resin, is known, wherein the fiber base material is processed in an aqueous slurry, the phenol resin is processed in the form of an emulsion and the filler is processed into a stock solution. The stock solution is applied in the form of a paper production process to a long screen, rolled and dried. During the drying process, the phenol resin is cured under the influence of temperature.

SUMMARY

An object of the present disclosure is the further development of a method for producing a wet-running friction paper. In particular, the object of the present disclosure is to simplify the production of a wet-running friction paper and to improve its properties.

The object is achieved by a method for producing a wet-running friction paper which contains at least one fiber fraction consisting of at least one type of fiber, a fraction of at least one filler, and a fraction of a binder based on phenol resin. The fiber fraction, the filler fraction and the binder dissolved as a phenolate solution are processed together in a paper production process to form a pulp and the binder is subsequently precipitated by means of a precipitating agent, preferably diluted sulfuric acid, and the pulp applied to a long screen is dried and cured while the temperature is raised.

DETAILED DESCRIPTION

The proposed method is used to produce wet-running friction paper or a layered friction material for friction, clutch and/or braking devices, in particular in a motor vehicle. The wet-running friction paper contains a fiber fraction of at least one type of fiber, for example aramid fibers, carbon fibers, cotton fibers such as linter fibers and/or the like, a fraction of at least one filler, for example kieselguhr, such as Celite, graphite, coke and/or the like, and a fraction of a binder based on phenol resin, for example phenol resol and/or the like. Further fractions such as silicone resin, silanes, flocculants, retention agents, friction particles and/or the like can be provided.

The wet-running friction paper is manufactured in a paper production process. This means that, for example, a slurry such as pulp or suspension is formed from the fiber fraction and the at least one filler. The fibers are in short cut form, for example with a length of a few millimeters. The high-water-content pulp also contains the binder fraction, in which a phenol resin component is present as phenolate, possibly alongside other resin fractions, in that the phenol resin is dissolved in a strongly alkaline solution, for example in a sodium or potassium hydroxide solution.

The pulp is processed into the wet-running friction paper in a papermaking process known per se. For example, the pulp is placed on a long screen and rolled in a wet press unit and brought to the appropriate thickness. The pulp is then dried with further rolling, if necessary. In this case, in a dry phase, corresponding rollers can be brought to higher temperatures than the rollers in the wet phase in order to evaporate the remaining solvent, for example water.

According to the present disclosure, the phenol resin fraction present dissolved in the pulp as phenolate of the phenol resin is precipitated. For this purpose, the pH of the alkaline pulp is lowered by adding acid, for example the pulp is neutralized, as a result of which the phenolate is converted into an insoluble phenol resin and is precipitated. A dilute acid, such as 5% sulfuric acid, for example, can be used as the precipitating agent. The precipitation process is preferably carried out in the wet phase at room temperature or ambient temperature of the papermaking process.

By means of the precipitation process and preferably the use of retention agents, a uniform distribution of precipitated phenol resin particles can be achieved over the entire area of the pulp lying on the long screen. In this way, after the pressing and rolling process of the paper production process and drying of the finished wet-running friction paper, a lateral and uniform distribution of the phenol resin particles can be achieved over its thickness between the two surfaces so that the friction quality of a friction partner made from the wet-running friction paper has essentially consistent friction properties over its service life.

Furthermore, a particle size of precipitated binder particles such as phenol resin particles can be adjusted by means of a predetermined addition rate of the precipitating agent. In particular, by adding the precipitant at a rate of 0.5 kg/s, for example, it is possible to achieve particularly small particle diameters of the phenol resin, in particular phenol resol, in the range between 200 and 1600 nanometers, which penetrate the fibers or fiber bundles of the fiber fraction and attach themselves to the fibers in an even distribution.

By adding appropriate flocculating agents and/or retention agents, a suitable zeta potential of 80 mV±8 mV, for example, can be set so that a high conversion of the flocculation, essentially 100% addition of the phenol resin, can be achieved.

Improved reinforcement properties, for example in the gluing process of the wet-running paper on a corresponding carrier such as carrier plate or the like, are achieved by appropriate adjustment of the rheological properties of the pulp. Adjusting the viscosity to less than 3000 Pa*s, based on a dwell time of 800 s, has proven to be advantageous here. The viscosity can change with other dwell times and it may be necessary to trace the viscosity back to the specified dwell time in order to determine its viscosity.

The degree of hardness of the binder, such as phenol resin, and thus its abrasion resistance, elasticity, temperature resistance and/or the like can be adjusted in a dry phase of the papermaking process. In this case, a uniform temperature can be set on the rollers or an increasing or decreasing temperature profile can be set gradually from roller to roller in the drying phase. The positive properties of wet-running paper, in particular its reinforcing effect when it is glued to a carrier material, depends on the adjustment of the activation potential of the curing process of the binder. For this purpose, the phenol resin and its reactants are advantageously adjusted in such a way that the activation energy of the curing process is greater than 60 KJ/mol with a frequency factor ln20 and a reaction order <1.5.

An advantageous composition for producing the wet-running friction paper can, for example, contain

- a fiber fraction of 40 to 60% by weight, in particular a mixture of aramid fibers, linter fibers and carbon fibers,
- a binder fraction of 30 to 40% by weight, in particular phenol resin, present as phenolate in alkaline solution,
- a filler fraction of 20 to 40% by weight, in particular Celite.

A particularly advantageous composition contains, for example, in percent by weight

- 26% aramid fiber
- 6% linter fiber
- 9% carbon fiber
- 30% phenol resin such as phenol resol, present as phenolate in a highly alkaline solution with subsequent precipitation,
- 29% Celite.

The present disclosure also provides the described wet-running friction paper, produced in particular according to the proposed method. The wet-running friction paper has a uniform distribution of resin particles between the two opposite surfaces thereof. The particle size of the binder particles formed from the binder fraction is preferably between 200 and 1600 nm. After the papermaking process has been completed, the wet-running friction paper is in sheet form or roll form. The production of friction linings from this wet-running friction paper takes place depending on the later use thereof as a radially or axially effective friction lining by punching, cutting out or the like in the form of a ring or ring segment with radial or axial friction surfaces. Subsequent to the papermaking process or in the dry phase, profiling of the surfaces of the friction lining or the wet-running friction paper can be provided on the intended friction surfaces, for example by means of different intensities of pressing. Alternatively or additionally, application-specific required punctures can be provided.

The present disclosure also provides a friction lining, brake lining and/or the like produced from the wet-running friction paper.

In summary, at least one, advantageously several of the following adjustment parameters are advantageous in the production process of a proposed wet running paper:

- The particle size of the precipitated resin particles is adjusted using a combination of the properties of the binder, in particular a phenol resol, and the precipitation conditions of the phenolate using an adjusted pH value of the acid used, such as sulfuric acid, and the precipitation rate, i.e., the rate at which the acid is added.
- The rheological properties are adjusted by adding appropriate water or solvents and, if necessary, adding superplasticizers in order to ensure the reinforcing effect through sufficient flow of the resin.
- The adjustment of the zeta potential is set by the quality of the binder, for example its polarity and the type and number of functional groups and the properties of the pulp. The adjustment of the described zeta potential serves as a prerequisite for the precipitated particles to be securely bound to the fiber fraction.
- The reaction behavior with the specified activation energy serves to ensure that the wet-running paper, in combination with the adjustment of the drying of the pulp, achieves the necessary curing, as well as a good final curing during the gluing process during a gluing with a carrier material. Appropriate adjustment of the activation energy ensures that the wet-running paper does not stick to the drying cylinder during the dryer section of the paper machine, and gluing times of the wet paper to the carrier material are preferably well under one minute.

What is claimed is:

1. A method for producing a wet-running friction paper comprising:

at least one fiber fraction consisting of at least one type of fiber, a fraction of at least one filler, and a fraction of a binder based on phenol resin, the method comprising:

processing the fiber fraction, the filler fraction and the binder dissolved as a phenolate solution together in a paper production process to form a pulp;

subsequently precipitating the binder by a precipitating agent;

drying the pulp on a long screen and curing the pulp while a temperature of the pulp is raised, wherein particles of the binder are precipitated with a particle size between 200 and 1600 nm as a result of the precipitating of the binder.

2. The method according to claim 1, wherein the binder is phenolate resol.

3. The method according to claim 1, wherein a zeta potential of the pulp corresponds substantially to 80 mV.

4. The method according to claim 1, wherein the pulp is adjusted to a viscosity of less than 3000 Pa*s, based on a dwell time of 800 s.

5. The method according to claim 1, wherein the binder is adjusted to an activation energy greater than 60 KJ/mol with a frequency factor ln20 and a reaction order <1.5 during the curing thereof.

6. The method according to claim 1, wherein a particle size of precipitated binder particles is adjusted by a predetermined addition rate of the precipitating agent.

7. The method according to claim 1, wherein the binder is brought to a predetermined degree of hardness in a dry phase of the paper production process.

8. The method according to claim 7, wherein a degree of hardness of the binder is adjusted during curing of the pulp by a predetermined temperature curve.

9. The method according to claim 1, wherein the fiber fraction is of 30 to 60% by weight, the binder fraction is of 20 to 40% by weight, and the filler fraction is of 20 to 40% by weight.

10. The method as recited in claim 1 wherein the precipitating of the binder by the precipitating agent includes lowering a pH of the pulp by adding an acid to the pulp to precipitate the dissolved binder.

11. The method as recited in claim 10 wherein the acid converts the phenolate into an insoluble phenol resin.

12. The method as recited in claim 10 wherein the acid neutralizes the pulp.

13. The method as recited in claim 10 wherein the acid is sulfuric acid.

14. The method as recited in claim 10 wherein the lowering of the pH of the pulp by adding the acid to the pulp to precipitate the dissolved binder is carried out in a wet phase at room temperature or ambient temperature.

15. The method as recited in claim 1 wherein the binder is dissolved in an alkaline solution.

16. The method as recited in claim 15 wherein the alkaline solution is a sodium or potassium hydroxide solution.

17. The method as recited in claim 1 wherein the dissolved binder is present as a as a phenolate of a phenol resin.

18. The method as recited in claim 1 wherein particles of the binder are precipitated with a particle size between 200 and 1600 nm as a result of the precipitation of the dissolved binder.

* * * * *